US010446124B2

(12) United States Patent
Jacobson et al.

(10) Patent No.: US 10,446,124 B2
(45) Date of Patent: Oct. 15, 2019

(54) INCLINED TWO-GUITAR STAND

(71) Applicants: Adam Daniel Jacobson, La Crosse, WI (US); Ryan Patrick Sauter, La Crosse, WI (US)

(72) Inventors: Adam Daniel Jacobson, La Crosse, WI (US); Ryan Patrick Sauter, La Crosse, WI (US)

( * ) Notice: Subject to any disclaimer, the term of this patent is extended or adjusted under 35 U.S.C. 154(b) by 0 days.

(21) Appl. No.: 16/147,623

(22) Filed: Sep. 29, 2018

(65) Prior Publication Data

US 2019/0103079 A1 Apr. 4, 2019

Related U.S. Application Data

(60) Provisional application No. 62/566,462, filed on Oct. 1, 2017.

(51) Int. Cl.

*G10C 5/00* (2019.01)
*G10G 5/00* (2006.01)
*G10G 7/00* (2006.01)

(52) U.S. Cl.

CPC ..... *G10G 5/00* (2013.01); *G10G 7/00* (2013.01)

(58) Field of Classification Search

CPC ..... G10G 5/00; G10G 7/00
See application file for complete search history.

(56) References Cited

U.S. PATENT DOCUMENTS

| | | | | |
|---|---|---|---|---|
| 4,205,818 | A | 6/1980 | Lawler | |
| 4,561,339 | A | 12/1985 | Jensen | |
| 6,720,490 | B1 | 4/2004 | Bruce | |
| 7,131,615 | B1 * | 11/2006 | Bruce | A47B 19/002 248/127 |
| 7,291,775 | B2 | 11/2007 | Yu | |

FOREIGN PATENT DOCUMENTS

EP 2153744 A2 2/2010

* cited by examiner

*Primary Examiner* — Kimberly R Lockett

(57) ABSTRACT

The present invention is directed to a guitar stand that includes a base, an upright support, and, optionally, a music holder. The top surface of the base may be at an inclined angle relative to a floor or surface on which the base (and guitar stand) is positioned. The top surface of the base is designed to receive, and make available for use, one or more effects pedals that a guitarist might choose to employ during a performance. The upright support, which is attached to the base at an inclined angle, is designed to hold two guitars. A music holder, if present, is attached to the end of the upright support opposite the support's attachment to the base, is designed to hold music, an electronic device for displaying information (e.g., music), or both.

11 Claims, 9 Drawing Sheets

INCLINED TWO-GUITAR STAND

This application claims the benefit of U.S. Provisional Patent Application No. 62/566,462, entitled "Inclined Two-Guitar Stand," filed 1 Oct. 2017.

BACKGROUND

Many musicians perform in front of audiences. To do so they typically transport, and have access to, several pieces of equipment: one or more instruments; accessories necessary to, or for customizing, the production of sound from the instrument(s); a stand or case for storing the instrument when not being used (e.g., during breaks in the performance, or when a musician changes instruments); a holder for music or other document(s); microphone(s) for amplifying the sound produced by an instrument or a human voice; etc.

In particular, performers who play guitars often transport, and have available, one or more of the following: one or more guitars; effects pedals that give the guitarist a hands-free method for modifying sound produced by the guitar (e.g., a guitarist might have an effects pedal that allows the guitarist, by stepping on the pedal, to change the volume of the amplified sound produced by the guitar); a holder for music or other hard-copy document; a microphone for amplifying the sound of the guitar (e.g., an acoustic guitar) or the sound of a human voice; etc. And even if a guitarist does not perform in front of audiences, or is practicing for a performance at some venue, he or she may need these very same items.

Guitarists who make use of the items listed in the previous paragraph face a problem: how to organize the guitar, or guitars; effects pedals; music holder; and/or microphone such that all of these items are in one reasonably compact area (e.g., in the venue where the guitarist is performing). Furthermore, these same items should be stored or positioned so that they are readily accessible and not easily knocked over or kicked away during a performance, practice, or other such session. What is needed, then, is a stable guitar stand that also serves as an effects-pedal receptacle (i.e., a pedal board), and optionally, a music holder and/or microphone holder.

SUMMARY

We have invented a guitar stand that allows a performer to stably store up to two guitars in a generally upright position. One guitar typically hangs vertically from one guitar holder attached to one side of an inclined, upright support. A second guitar typically rests on the opposing side of the inclined support. As is discussed below, this novel configuration makes for a more stable guitar stand. Furthermore, the stand is designed to receive and support one or more effects pedals. In one version of the invention, the stand is designed to receive the pedals at an inclined position relative to the guitarist. The stand may also include a holder for hard-copy documents, such as music, or an electronic device, such as a tablet, for displaying information (e.g., music, the list of songs to be performed, etc.); a holder for a microphone; or both.

These and other representative embodiments of the inventive guitar stand are described below.

DRAWINGS

DESCRIPTION

Figure 1:
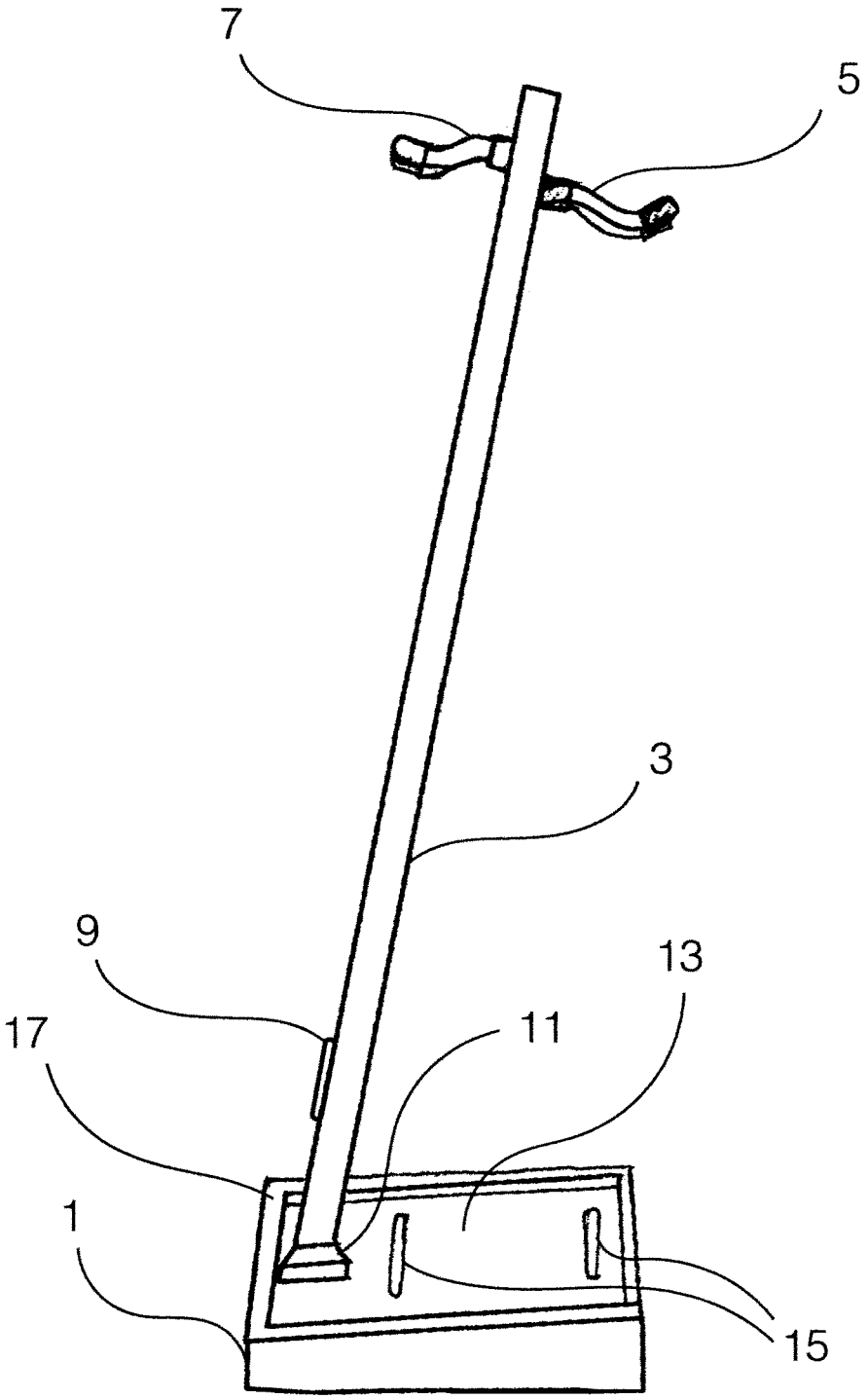
FIG. 1 shows a perspective view of one version of the inventive guitar stand.

FIG. 1 shows one representative version of our inventive guitar stand. The guitar stand includes a base 1, an inclined support 3, and guitar holders (also known as guitar hangers) 5 and 7. The representative version shown in FIG. 1 also includes a guitar rest (or guitar spacer) 9, which serves to separate the body of a guitar from the inclined support 3. Typically, the thickness of the guitar rest is such that the back surface of a guitar positioned on the guitar stand using guitar holder 7 is substantially parallel to the inclined support 3. The material of construction of the spacer may be selected to reduce the risk of a guitar body becoming marred when positioned on the stand. For example, the guitar rest may be made of cork, rubber, a fabric- or felt-covered pad, or other such conventional materials and/or parts. The guitar rest can be attached to the inclined support using any conventional fastening element, such as a metal fastener, a self-adhesive strip, double-sided tape, nails, screws, or the like. The pad is typically three to six inches long, one to two inches wide, and one-half to one inches thick, although the size and shape of the guitar rest may be varied.

The representative version shown in FIG. 1 shows an inclined support 3 attached to a pedestal 11, with the pedestal 11 attached to the top 13 of base 1. The inventive guitar stand need not include a pedestal. A pedestal, however, can serve to increase the stability of the connection between the inclined support 3 and the base 1, as discussed below. Furthermore, a pedestal may add a decorative appearance to the stand.

FIG. 1 also shows two slots 15 incorporated into the top 13 of base 1. The slots are openings in the top 13 of the base, and are adapted to receive wires connected to one or more effects pedals placed on the upper surface of top 13 of base 1 (note: some artists may connect two or more effects pedals together—i.e., "daisy chain" the effects pedals—thus allowing the artist to combine different effects from different pedals). While some effects pedals are capable of operating on electricity generated by one or more batteries (e.g., 9-volt batteries), many artists prefer to connect the effects pedal(s) to a separate, external power supply, which is then connected to an electrical network (e.g., in the U.S., 120 volts, 60 Hertz, alternating current; the external power supply converts the traditional U.S. household current to 9 volts, direct current). Also, in addition to a power cord, an effects pedal will include other wires or cables required for an effects pedal's operation (e.g., an effects pedal that controls the volume of an electric guitar will typically include a wire or cable connected to the guitar; and a wire or cable connected to the guitar's amplifier). Accordingly, one version of the invention includes one or more slots 15 adapted to receive one or more cords or wires, including power cords, that connect any effects pedal(s) to a separate power supply (the cords may be passed through the slot, and under the top 13 of base 1, so that a portion of the cord is hidden from view, thereby providing a neater, more organized area in which the artist is practicing or performing). Other cords or cables from an effects pedal may also be directed to and through a slot. In one version of the invention, the slot openings are about one-fourth to three-fourths inches wide, and about eight inches to about ten inches in length. Other dimensions may be chosen, of course, so long as cords or wires may be passed through the slot(s).

Any external power supply to which one or more effect pedals are connected may be positioned directly under the top of the base, with the cord connecting the power supply to an electrical outlet passing through an opening in the side of the base (see discussion below) or, alternatively, with the cord connecting the power supply to an electrical outlet being passed upward, through one of the slots, to an electrical outlet.

In the representative version of the invention shown in FIG. 1, the upper surface of top 13 of base 1 is bounded by a raised edge 17. In other words, the top surface 13 of the base is lower than the raised edge 17. Typically the raised edge 17 is between about one-eight of an inch to about one-fourth of an inch above the upper surface of top 13, although the height of the raised edge can be varied. As discussed elsewhere in the application, the raised edge reduces the chance of an effects pedal sliding off the top surface of the base onto the floor (i.e., to the extent the effects pedal is not otherwise attached, directly or indirectly, to the base of the guitar stand). It should be noted, however, that some versions of the inventive guitar stand do not include a raised edge around the top surface of the base.

Figure 5:
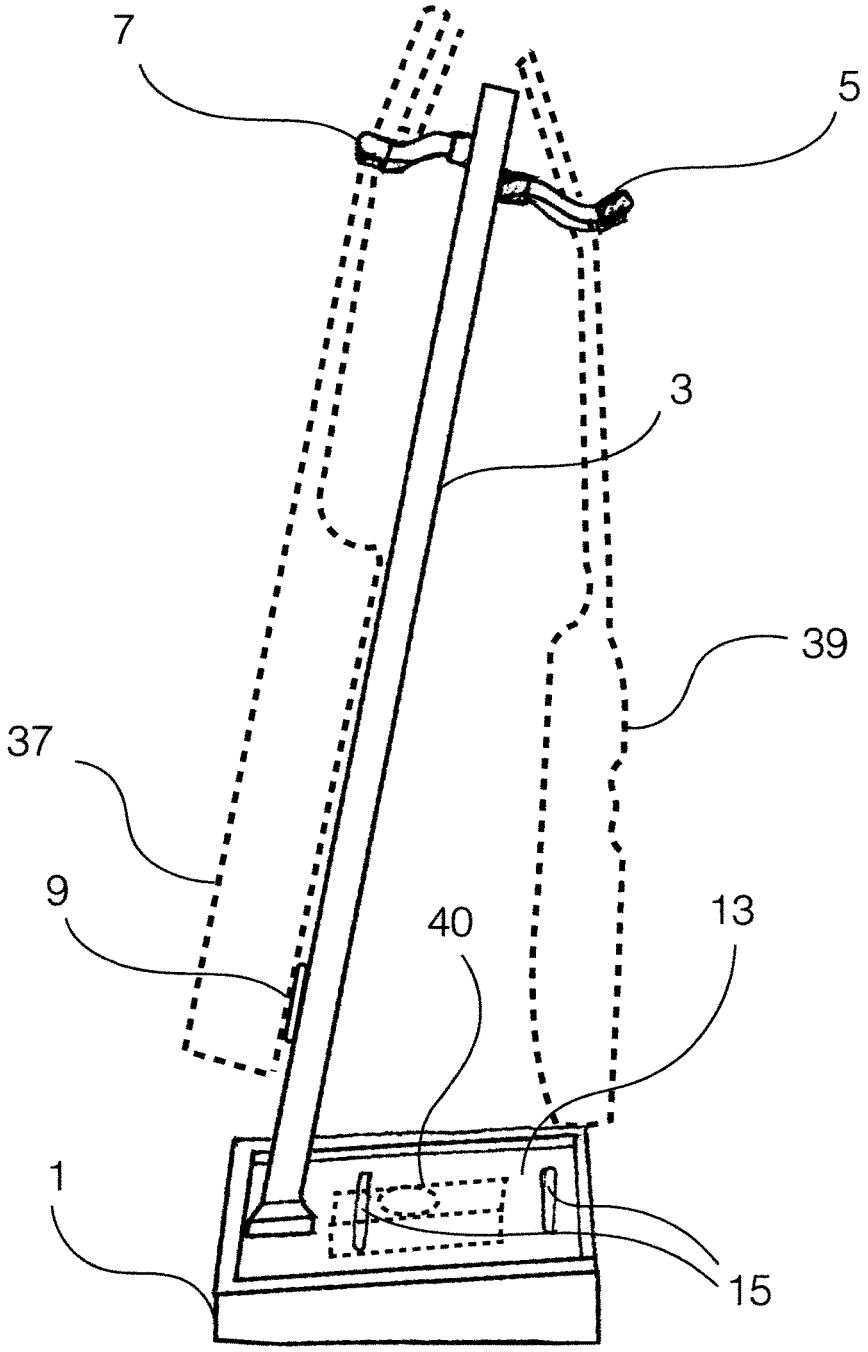
FIG. 5 shows a perspective view of one version of the inventive guitar stand.
Figure 6:
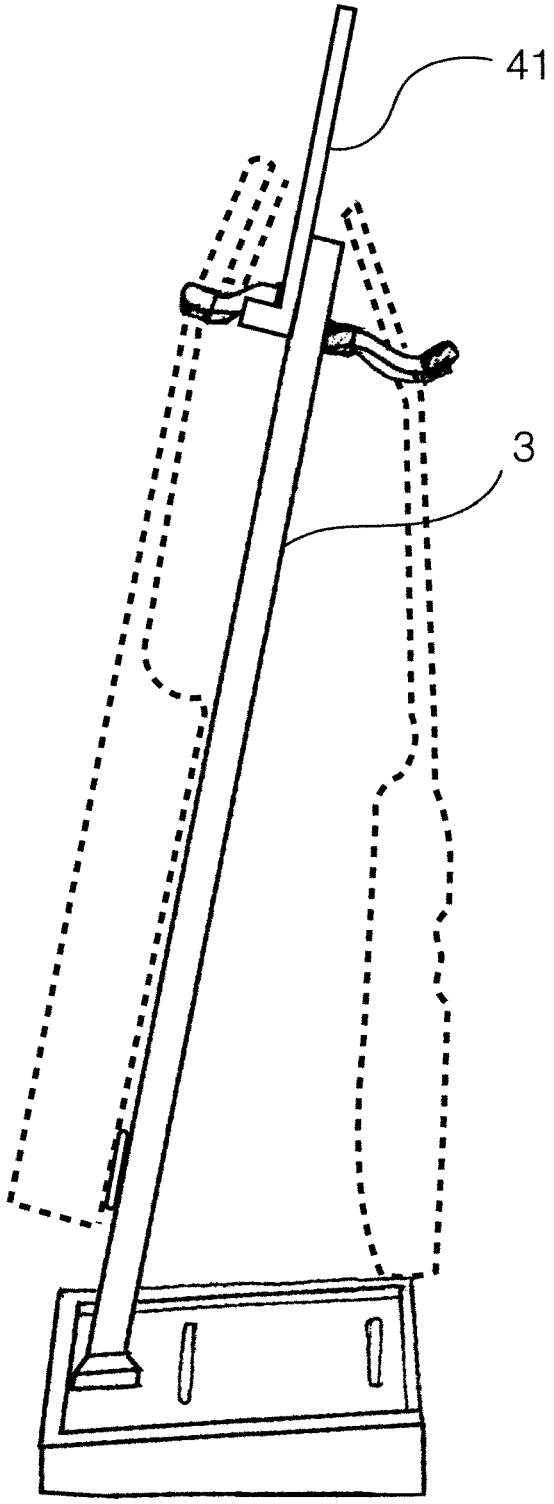
FIG. 6 shows a perspective view of one version of the inventive guitar stand.
Figure 7:
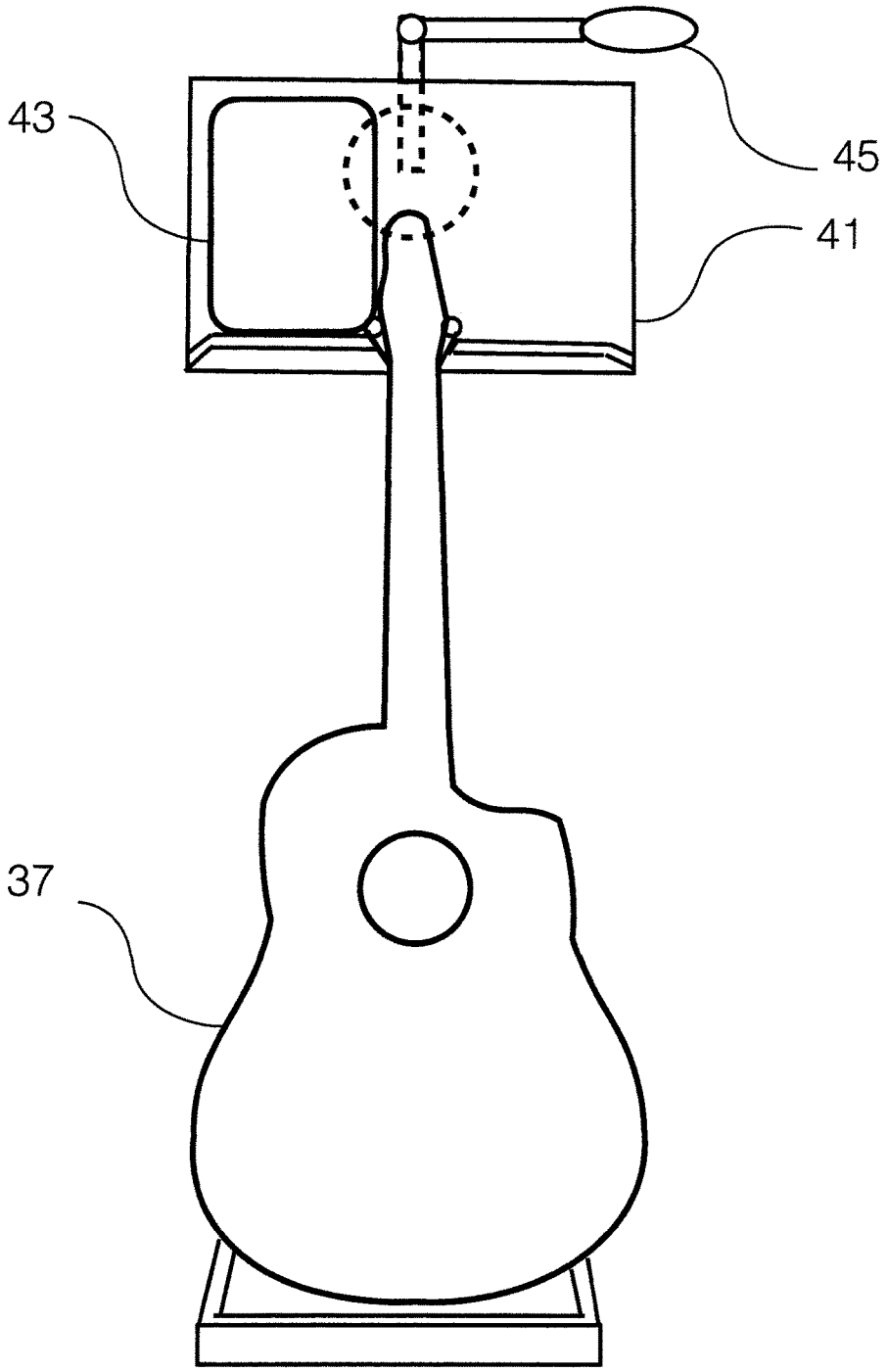
FIG. 7 shows a perspective view of one version of the inventive guitar stand.

FIG. 1 does not show a music holder. Nor does FIG. 1 show two guitars placed on the guitar holders. A version of the guitar stand with a music holder is shown in FIGS. 6 and 7. FIGS. 5, 6, and 7 show guitars placed on the stand, with the guitars represented by dotted lines.

In one version of the invention, the base 1 and inclined support 3 are made of wood, but other materials of construction may be used (e.g., metal or plastic). Much of the description herein pertains to a representative embodiment in which wood is used as the material of construction.

The inclined support 3 may be attached to base 1, directly or indirectly (e.g., via a pedestal 11), using any conventional attachment components or materials, such as screws, adhesive (including use of an adhesive in conjunction with various kinds of conventional joints, such as dowel joints), a nut-and-bolt fastener, other conventional joints for connecting wood pieces together, solder or welding or other such joints if metal is used, injection molding or fusing or other such materials for joining plastic components (if used), and the like.

Guitar holders (or hangers) 5 (denominated the backside guitar holder or hanger) and 7 (denominated the front-side guitar holder) may be any conventional holder for holding or hanging a guitar. Typically such holders include a U-shaped bracket. The opening in the U-shaped bracket is large enough to receive the neck or fret board of a guitar. The headstock of the guitar, which is joined to, and is wider than, the fret board/neck of the guitar, rests on the bracket. Any conventional guitar holder or hanger may be used with our inventive guitar stand, so long as the holder/hanger is capable of receiving, and storing, a guitar. The guitar holder or hanger may be connected to the guitar stand using any conventional connector, fastener, nut-and-bolt combination (e.g., a threaded nut, such as a brass insert, may be inserted into a hole drilled into the inclined support, with the diameter of the hole selected to receive the threaded nut or brass insert; the guitar hanger may then be screwed into the threaded nut/brass insert, thereby connecting the guitar hanger to the inclined support), screw(s), etc.

In one version of the invention, the inclined support and base are not permanently attached to one another. Instead, a person using the inventive guitar stand may transport unassembled portions of the stand (e.g., the inclined support and base) to the venue where he or she is performing, and assemble the guitar stand at the venue. So, for example, in one version of the invention, one end of the inclined support includes a recessed, threaded nut/brass insert (not shown). A person assembling the guitar stand would match the location of the recessed nut in one end of the inclined support with an opening in the top 13 of base 1. Typically the shape of the opening in the top surface of the base is circular, with a diameter that permits a bolt to be inserted through the circular opening in the base and into the recessed nut formed in the inclined support 3, the pedestal 11 (if present), or both. The location of the opening in the top of the base fixes the position of the inclined support relative to the base once the guitar stand is assembled. For stability, and the strength of the connection between the base and the inclined support, more than one recessed nut/brass insert may be included in the end of the support. If, for example, two bolts are to be used to attach the inclined support to the base, then the inclined support would include two recessed nuts/brass inserts; the base would include two openings (or one slot able to receive two bolts), the locations of which permit the insertion of two bolts, one through each of the two openings in the base, and into the corresponding recessed nuts in the inclined support.

In one version of the invention, the inclined support 3 has a substantially rectangular cross-section measuring about one and one-half inches by about one and three-fourths inches, and is about 41 and ½ inches in length. Of course other dimensions and cross-sectional shapes may be used for the inclined support, so long as the resulting guitar stand is able to store and support two guitars.

At the bottom of the inclined support 3 (i.e., the portion of the inclined support that attaches to the top 13 of the base 1) there is a pedestal 11 (one exemplary version of the pedestal having dimensions of about 2 and ¾ inches wide by 3 inches long, with a height of about ⅞ inches) that is faceted for decorative looks. The end of the inclined support that attaches to the pedestal is cut at an angle so that the support is inclined relative to the surface on which the base rests (see description below regarding FIGS. 2 and 3, which pictorially represent the base angle of inclination and the support angle of inclination, terms which are also defined below).

The end of the inclined support may be attached to the pedestal using any conventional attachment element (e.g., adhesive, screws, nails, nut-and-bolt combinations, and the like). In one version of the invention, the inclined support is attached to the pedestal using three wood screws that are inserted into the bottom of, and through, the pedestal and into the end of the inclined support. As noted above, for those versions of the invention that include a pedestal, the pedestal may be attached to the top of the base using one or more bolts that pass through one or more openings in the base. The bolt, or bolts, is then threaded into recessed nuts/brass inserts in the pedestal (i.e., the pedestal can include recessed nuts/threaded brass inserts into which bolts may be threaded to secure the inclined support 3, which is attached to pedestal 11, to the top 13 of base 1).

One exemplary recessed nut/brass insert that may be used with versions of the present invention have a length of about ½ inch, an inner diameter of about ¼ inch, and an outer diameter of about 7/16 inch). Such recessed nuts/brass inserts may be used at various locations on the inclined support to allow for: (1) attaching the guitar holders/hangers to the inclined support; (2) attaching the music holder (not shown in FIG. 1, but discussed below) to the inclined support; and (3) attaching the inclined support, either directly, or indirectly through the pedestal to the base.

In one version of the invention, the front side of the inclined support (i.e., the side of the inclined support that faces a user of the guitar stand) includes two brass inserts/recessed nuts adapted to receive the bolt of the first, or front-side, guitar hanger 7 and, if a music stand is used, a second bolt (i.e., a bolt protruding from the end of the first, or front-side, guitar hanger 7 is inserted through a circular opening in the music holder and into the brass insert/threaded nut in the inclined support; the guitar hanger is then rotated until the hanger is securely threaded into the brass insert/recessed nut in the upper portion of the inclined support, thereby fastening the first, or front-side, guitar hanger 7 to both the music holder and the inclined support; a second bolt is inserted through a second opening in the music holder and into a second brass insert/threaded nut in the inclined support). If a music holder is not used, only one of the recessed nuts/brass inserts in the front side of the inclined support 3 would be used (for the front-side guitar hanger/holder 7); the other brass insert/recessed nut for the music holder could be plugged with a matching wood plug (which could be removed when a user wished to attach a music holder). On the backside of the inclined support an additional brass insert/recessed nut is adapted to receive the backside guitar hanger/holder 5.

In the version of the invention shown in FIG. 1, the top 13 of base 1 is inclined relative to the floor or surface on which the base (and therefore the guitar stand) rests. Top 13 is inclined so that an effects pedals resting on the upper surface of top 13 is more easily accessed by a performer standing in front of the inventive guitar stand. It should be noted, however, that top 13 could be parallel to the floor or surface on which the base rests, so long as any effects pedals is accessible to a performer (e.g., in some cases effects pedals themselves have an inclined upper surface, and therefore a horizontal top could be used in conjunction with such effects pedals; nevertheless, an inclined surface is preferred, as an inclined upper surface of top 13 likely makes most effects pedals more accessible to a performer).

Figure 2:
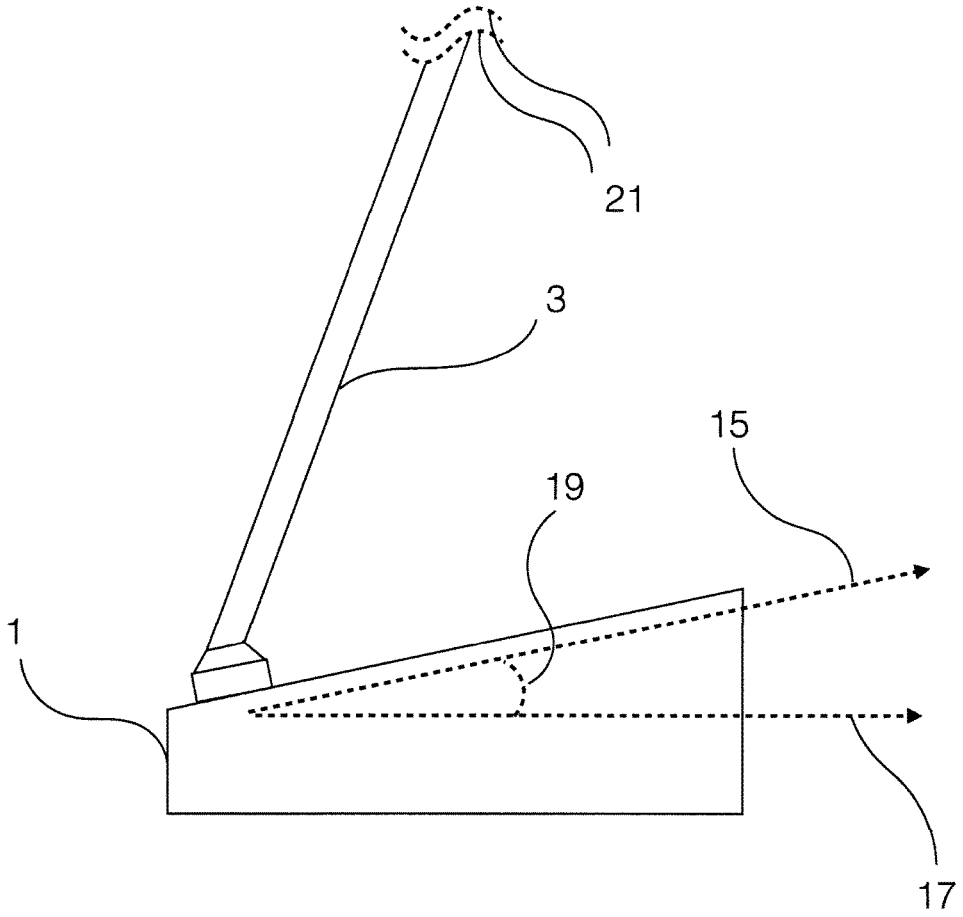
FIG. 2 shows a side view of one version of the inventive guitar stand.

FIG. 2 shows a side view of one version of the guitar stand, with imaginary rays 15 and 17, represented by dotted lines, superimposed on the base, thereby defining a base angle of inclination 19 (with the base angle of inclination having a measure, in degrees, equaling the measure of the minor angle defined by rays 15 and 17, with the endpoints of these rays located at the vertex of the angle; the base angle of inclination 19 is represented by a dotted arc drawn between the two rays 15 and 17). Ray 17 is parallel to the surface on which the guitar stand rests. Ray 15 overlays the upper surface of top 13 (not shown), with the upper surface of top 13 typically parallel to the topmost edge of the base itself. The two rays intersect to define the base angle of inclination 19. The base angle of inclination 19 is typically between about 2 degrees and 20 degrees; suitably between 3 degrees and 10 degrees; particularly between 4 degrees and 8 degrees (in some versions of the invention the base angle of inclination is zero—as in the embodiment described above in which the upper surface of top 13 is parallel to the floor or surface on which the base rests).

Other base angles of inclination may be selected, so long as the resulting guitar stand has a center of mass located over the base of the guitar stand. Furthermore, the base angle of inclination should be selected such that a performer can conveniently and comfortably access any effects pedal positioned on the top surface of the base. It should be noted that the s-shaped dotted lines 21 denote the fact that the entire guitar stand is not shown (i.e., the upper portion of the guitar stand, including the guitar holders and music holders, are not shown in FIG. 2).

Figure 3:
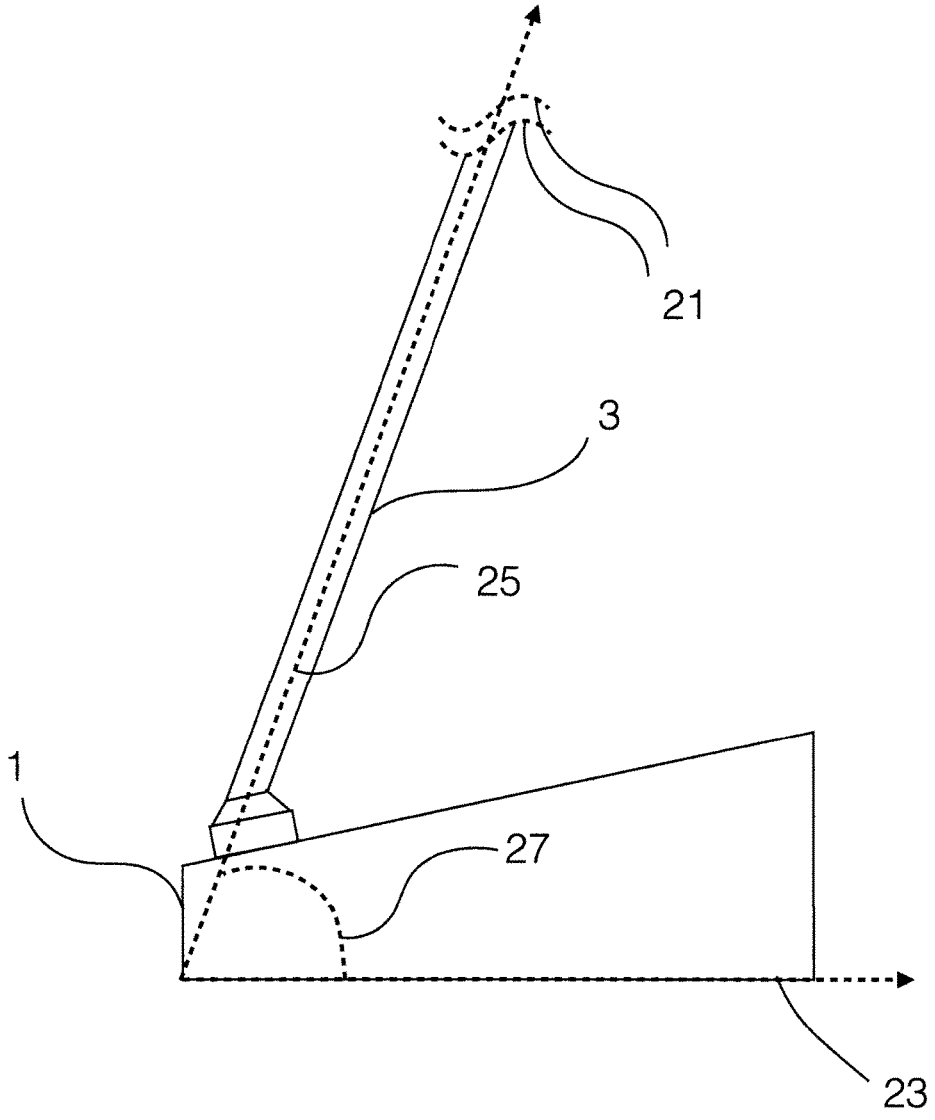
FIG. 3 shows a side view of one version of the inventive guitar stand.

FIG. 3 shows a side view of one version of the guitar stand in which the inclined support 3 is inclined relative to the surface on which the base rests. Imaginary rays 23 and 25 are superimposed on a drawing of the base, with ray 23 parallel to the floor or surface on which the guitar stand rests; and ray 25 superimposed on the centerline of the inclined support. The endpoints of the rays meet at the vertex of the support angle of inclination 27, which is the minor angle defined by rays 23 and 25 (the support angle of inclination 27 is represented by an arc-shaped dotted line between the two rays, and is measured in degrees). The support angle of inclination 27 is typically between about 60 degrees and 85 degrees; suitably between 70 degrees and 80 degrees. Other support angles of inclination may be selected, so long as the resulting guitar stand has a center of mass located over the base of the guitar stand. Furthermore, the support angle of inclination, coupled with the length of the inclined support, should be selected such that two guitars may be placed on the guitar holders attached to the inclined support (note: more detail on this feature is provided below). It should be noted once more that the s-shaped dotted lines 21 reflect the fact that the entire guitar stand is not shown (i.e., the upper portion of the guitar stand, including the guitar holders and music holders, are not shown in FIG. 3).

Figure 4A:
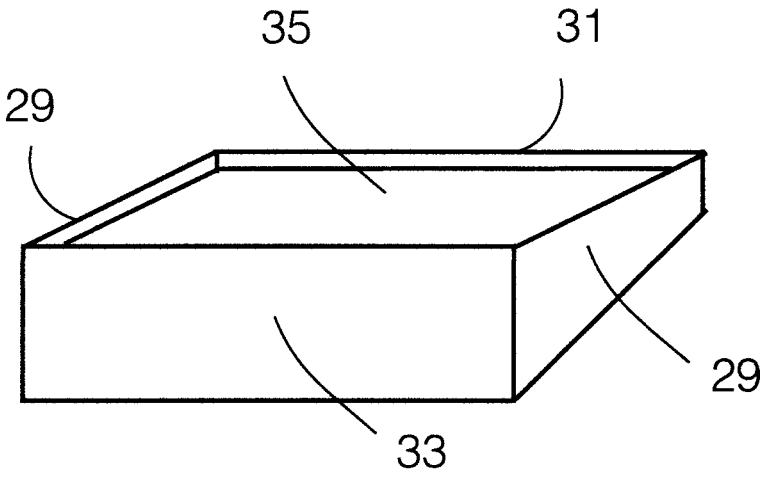
FIG. 4A shows a perspective view of one version of the base of the inventive guitar stand.
Figure 4B:
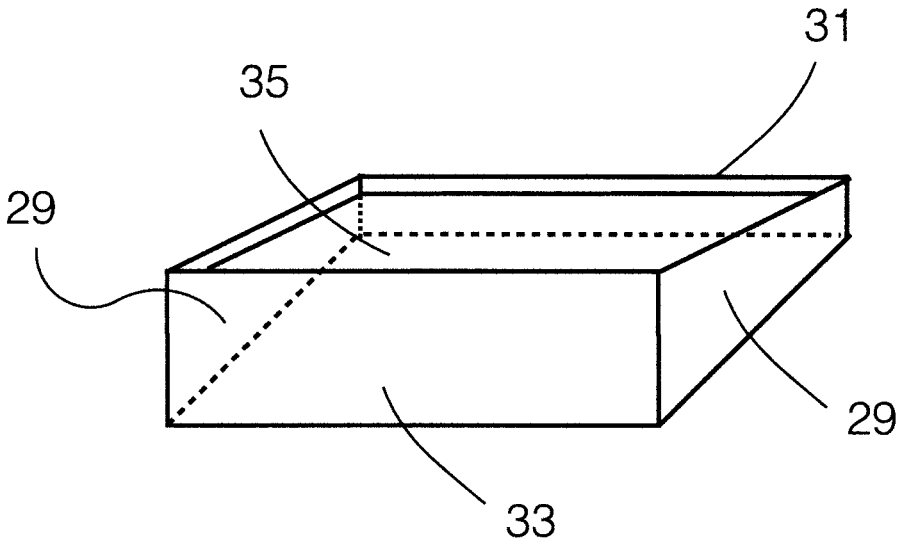
FIG. 4B shows a perspective view of one version of the base of the inventive guitar stand.

FIGS. 4A and 4B give perspective views of one version of a base (note: in these simplified drawings, the thickness of the front, back, sides, and top is not shown; if wood is used as the material of construction, then wooden boards used to make the front, back, sides, and top will typically have a thickness between about ½ and 1 inches (other thickness are possible); furthermore, any conventional components and materials may be used to join the front, back, sides, and top to one another to form the base including, as mentioned above for wood materials, screws, bolts, adhesive, conventional woodworking joints and/or fasteners, etc. The base is assembled from two opposing sides 29, a front 31, a back 33, and a top 35 (note: in FIG. 1 above the top of the base is denoted by number 13). It should be noted that the dotted lines in FIG. 4B depict how one of the sides 29, and the front 31, extend downward to form the bottom of the base, which rests on the floor or other surface on which the guitar stand is placed.

In one version of the invention, the opposing sides 29 of the base have a trapezoidal shape. In one embodiment of the base, length of the edge at the bottom of this trapezoidal shape (i.e., the edge that contacts the floor or other surface on which the guitar stand rests) is about 13 inches; the length of the vertical edge at the front of the trapezoidal shape is about 1.75 inches (note: the front of the base corresponds to the lower height of the inclined top surface of the base); the length of the vertical edge at the back of the trapezoidal shape is about 3 inches; and the length of the inclined edge at the top of the trapezoidal shape is about 13.06 inches (corresponding to a base angle of inclination of about 5.5 degrees). The lengths of these vertical edges, and there relationship to one another, may be varied to achieve different base angles of inclination.

The front of the base 31 has a generally rectangular shape, with its vertical edges having a length of about 1.75 inches, and the bottom and top edges having a length of about 15 inches. The back of the base 33 also has a generally rectangular shape, with its vertical edges having a length of about 3 inches, and the bottom and top edges having a length of about 15 inches. Again these dimensions may be varied.

The top 35 is also a rectangular piece having a length of 14 inches and a width of 12.5 inches. The rectangular piece is inserted into grooves formed in each of the two opposing sides 29, the front 31, and back 33 of the base. Additional detail of a groove in one of the generally trapezoidal sides is shown in FIG. 4C. FIG. 4C shows one of the sides of the base 29, without either the front or the back of the base, so that groove 30 is clearly seen. The top of the groove is typically cut about ¼ inches from the top edge of the sides, front, and back (but may also be formed at other locations in each of these parts of the base). A resilient member 32, such as a resilient sphere (often referred to as a "spacer ball"), is placed inside the groove. These resilient members are positioned at evenly spaced intervals along the length of the groove. The top 35 is inserted into the groove where it rests against, and compresses, the resilient member 32. These resilient members allow for some expansion and contraction of the top of the base. As noted above, each of the two opposing sides 29, the front 31, and back 33 has a groove, such as that depicted in FIG. 4C, which is adapted to receive top 35. The sides, front, and back are joined to one another with top 35 inserted into the grooves or channels. Adhesive, screws, or other conventional fastening components are used to join these elements together.

Figure 4D:
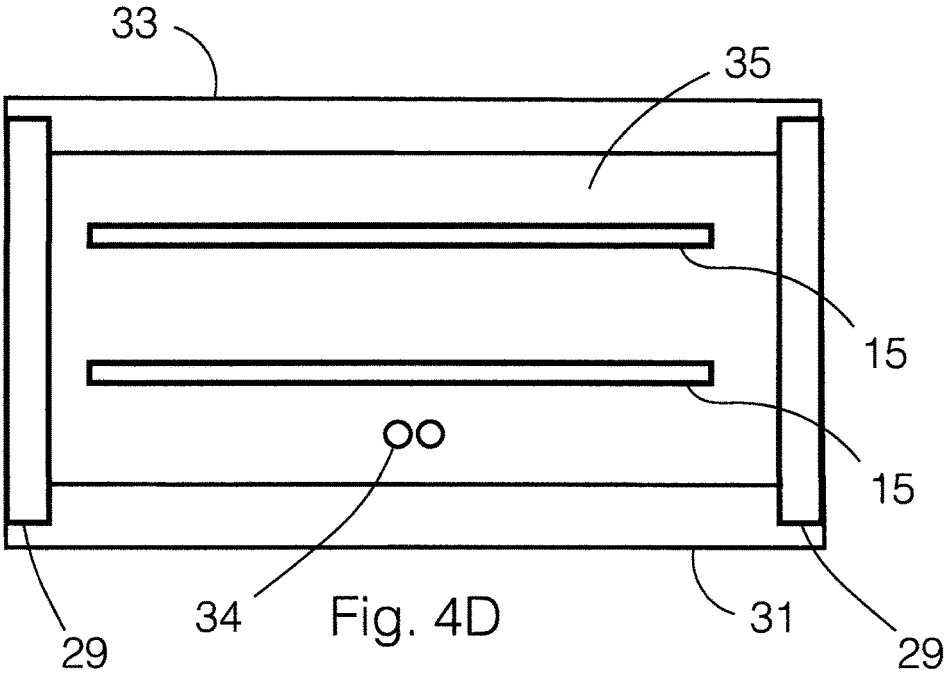
FIG. 4D shows a top view of one version of the base of the inventive guitar stand.
Figure 4C:
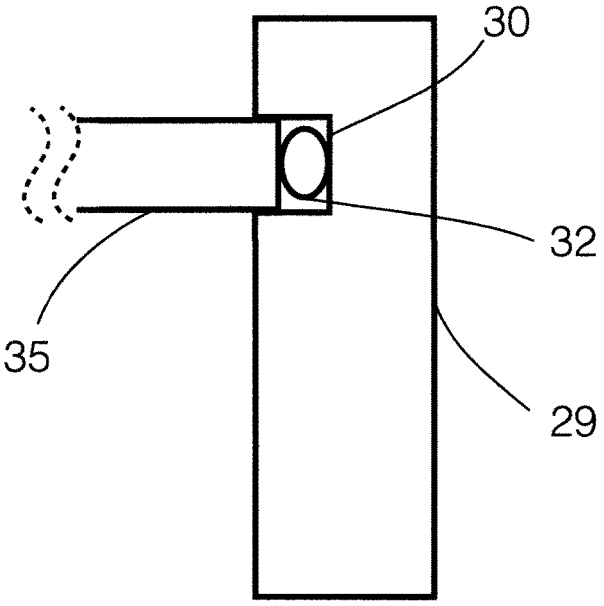
FIG. 4C shows a side view of one version of the base of the inventive guitar stand.

FIG. 4D shows a top view of the base. As noted above, sides 29, the front 31, and back 33 are joined to one another using conventional fastening or attachment elements (e.g., if wood is used to make the base, then the sides, front, and back are joined together using adhesive, screws, bolts, nails, or other such fastening elements, including combinations thereof). In the representative embodiment described above, each of the sides 29, the front 31, and back 33 includes a groove adapted to receive the top 35 (with a portion of the top proximate to the top's four edges inserted into each groove, the edge portion of the top contacting resilient members such as the above-described "spacer balls"). Furthermore, in the representative embodiment shown in FIG. 4D, both the front 31 and back pieces 33 include right angle cut-outs adapted to receive side pieces 29. The top includes two openings 15, through which cords or cables may be directed (e.g., from effects pedals resting on the top of the base). In one version of the invention, these openings are about 9 inches long and about one-half an inch wide. In one representative embodiment, one of these openings is about 1 and ¾ inches from the back 33; and the second opening is about 7 and ¾ inches from the back 33. As discussed above, the top may also include one or more openings 34 that facilitate connection of the base to the inclined support 11 from which one or two guitars may be stored. The representative embodiment shown in FIG. 4D includes two circular openings 34 through which bolts are inserted, the bolts then being threaded into brass inserts/recessed nuts in the inclined support (with or without a pedestal). In one version of the invention, these openings have a diameter of about 3/16 inches, are about 1 and ½ inches apart from one another, and are about 2 and ⅛ inches from the front 31. Furthermore, these openings are countersunk (i.e., beveled) to facilitate insertion of two 1 and ¼ inch long bolts through the openings and into the brass inserts/recessed nuts in the inclined support. It should be recognized, of course, that measurements given above, and elsewhere in the description, are illustrative of one embodiment of the invention; other measurements may be used.

FIG. 5 shows a side view of one version of the invention, in this case with two guitars positioned on the stand (with the guitars represented by dotted lines), and one effects pedal on the upper surface of top 13 of base 1 (again, the effects pedal is represented by dotted lines). One guitar, denominated as the first, or front-side, guitar 37 (because it is positioned on the first, or front-side, guitar hanger/holder 7 closer to the lower side of the base 1, which is identified as the front of the base; with the first, or frontside, guitar's fret board being received by the first, or frontside, guitar hanger/holder) is positioned so that the guitar's body rests directly or indirectly on the inclined support 3. As noted above, in some versions of the invention a guitar spacer or rest 9 is attached to the inclined support, and therefore is interposed between the front-side guitar and the inclined support. The second, or backside, guitar 39 hangs substantially vertically from the second, or backside, guitar holder/hanger 5 such that the guitar's body is over the base and is closer to the back of the base 1 (which is the higher side of the base). The second guitar's fret board is received by the second, or backside, guitar holder. And an effects pedal 40 rests on the upper surface of top 13 of base 1 (one or more cords connected to the effects pedal 40, and directed to and through one or both slots 15, are not shown).

As noted elsewhere, the support is inclined to lower the center of gravity of the stand (with or without one or two guitars mounted on the stand). A lower center of gravity should improve the stability of the stand. Furthermore, the support is inclined toward the center of the base so that the center of gravity is shifted over the stand's base. This too increases the stability of the stand, especially when one guitar is mounted on the stand. In a typical conventional stand capable of holding two guitars, a tripod-like base is attached to a central vertical support, the vertical support positioned so that the support is perpendicular to the surface on which the conventional stand rests. The vertical support usually includes two guitar holders located on opposing surfaces of the vertical support. If only one guitar is mounted on the guitar stand, then the weight of the single guitar shifts the center of gravity away from an imaginary vertical axis passing through the vertical support—i.e., away from the guitar stand's central vertical support and toward the stand's point of contact with the floor—thus making the stand potentially less stable.

FIG. 6 shows our inventive guitar stand with a music/device holder 41 attached to the inclined support 3. As with the base and inclined support, the music holder may be made of wood, plastic, metal, or other material. The holder may be connected to the inclined support 3 using any conventional fastening component (e.g., screws, nuts and bolts, adhesive, etc). In one version of the invention, a brass insert/threaded nut is inserted into a hole drilled into the inclined support (or, as is described above, to ensure that the music holder does not rotate around a single point of attachment, two brass inserts/threaded nuts are inserted into the inclined support). The music holder includes one or more openings, typically circular in shape, through which one or more bolts may be inserted and threaded into the brass inserts/threaded nut(s) in the inclined support. One of the bolts may be a bolt protruding from the end of the front-side guitar hanger/holder. Typically, as shown in FIG. 6, the music holder has a cross-section that generally resembles an L-shape, with the lower, more horizontal portion of the "L" capable of holding hard-copy music, electronic devices, and the like. In one version of the invention, the music/device holder is 18 inches wide, 12 inches high, and ⅝ inches thick. Other dimensions are possible, so long as the holder is capable of holding hard-copy documents, electronic devices, or both. Furthermore, the music holder may assume different shapes and configurations. For example, in one version of the invention, the music holder can be a U-shaped sleeve adapted to receive an electronic tablet or phone. In this instance, the inventive guitar stand is limited to displaying content via an electronic device, and is not designed to hold hard-copy documents such as music.

As noted above, in some versions of the invention the fastening components used to attach one or more of the components to one another (e.g., the base, inclined support, guitar hangers/holders, and music holder), and the design of the components themselves, may be chosen so that a performer can more easily transport one or more components in a generally laid-flat configuration. Once at a venue, the components are then attached to one another to form the inventive guitar stand.

FIG. 7 shows one version of our inventive guitar stand from another perspective. In this case a guitar 37, represented by dotted lines, is positioned at the front side of the guitar stand. The inclined support on which this guitar rests, either directly or indirectly, and a portion of the base, is behind the guitar and is not shown in the drawing. An electronic device 43 is positioned on the music holder 41. The music holder, in this version of the invention, is able to hold an electronic tablet, smart phone, hard-copy documents, or some combination thereof. Furthermore, an optional microphone 45 (along with an articulated or flexible arm, which allows a performer to position the microphone where needed to amplify sound; and a base) is attached to the back of the music holder. In the representative version shown in FIG. 7, the optional microphone is secured to the back of the music holders by screws threaded through the base support of the microphone, and into the music holder itself. A flexible or articulated arm, connected to the microphone's base, extends above and over the music holder to a location where the user of the guitar stand can use the microphone to amplify his or her voice, or instrument.

Figure 8:
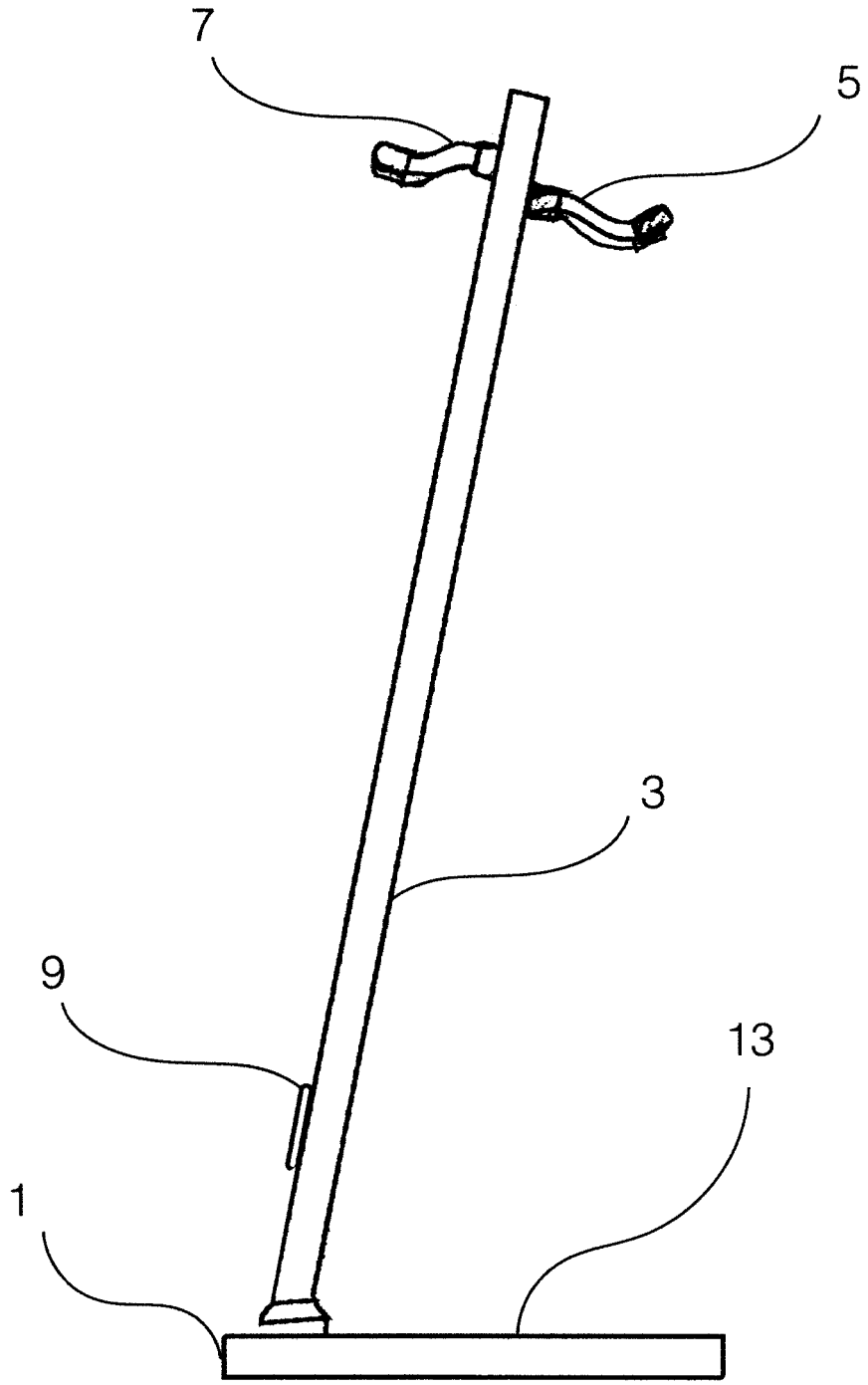
FIG. 8 shows a side view of one version of the inventive guitar stand.

FIG. 8 shows one version of an economical embodiment of the invention. In this particular version base 1 is a flat, solid, rectangular base. As noted above, in this instance the upper surface 13 of base 1 is parallel to the floor or surface on which the base rests. The version of the invention shown in FIG. 8 is assembled using conventional attachment elements as is described elsewhere herein with the exception that the inclined support 3 is attached to the aforementioned flat, solid base. In one representative embodiment of the invention, the base 13 is made of wood, with a length of about 20 inches, a width of about 15 inches, and a height of about 1 inch. Other dimensions are of course possible, so long as the selected dimensions result in a stable guitar stand.

It is to be understood that the embodiments of the invention herein described are merely illustrative of the application of the principles of the invention. Reference herein to details of the illustrated embodiments is not intended to limit the scope of the claims, which themselves recite those features regarded as essential to the invention.

We claim:

1. A guitar stand comprising:
a base;
an inclined support attached to the base;
a first guitar hanger attached to the inclined support; and
a second guitar hanger attached to the inclined support;
wherein the guitar stand is configured to hold a first guitar having a fret board and a body, such that the first guitar's fret board is received by the first guitar hanger and the first guitar's body rests on the inclined support;
and wherein the guitar stand is configured to hold a second guitar having a fret board and a body, such that the second guitar's fret board is received by the second guitar hanger and the second guitar's body hangs substantially vertically over the base.

2. The guitar stand of claim 1 having a support angle of inclination, wherein the support angle of inclination is between 60 degrees and 85 degrees.

3. The guitar stand of claim 1 having a support angle of inclination, wherein the support angle of inclination is between 70 degrees and 80 degrees.

4. The guitar stand of claim 1 wherein the upper surface of said base is inclined.

5. The guitar stand of claim 4 having a base angle of inclination, wherein the base angle of inclination is between 2 and 20 degrees.

6. The guitar stand of claim 4 having a base angle of inclination, wherein the base angle of inclination is between 3 and 10 degrees.

7. The guitar stand of claim 1 wherein the upper surface of said base includes an opening adapted to receive cords from one or more guitar effects pedals.

8. The guitar stand of claim 1 further comprising a music holder attached to the inclined support.

9. The guitar stand of claim 8 further composing a microphone attached to the music holder.

10. A guitar stand comprising:
a solid base;
an inclined support attached to the base;
a first guitar hanger attached to the inclined support; and
a second guitar hanger attached to the inclined support;
wherein the guitar stand is configured to hold a first guitar having a fret board and a body, such that the first guitar's fret board is received by the first guitar hanger and the first guitar's body rests on the inclined support;
and wherein the guitar stand is configured to hold a second guitar having a fret board and a body, such that the second guitar's fret board is received by the second guitar hanger and the second guitar's body hangs substantially vertically over the base.

11. The guitar stand of claim 10 wherein the solid base is wood.

* * * * *